US006718795B2

(12) United States Patent
Briglia

(10) Patent No.: US 6,718,795 B2
(45) Date of Patent: Apr. 13, 2004

(54) SYSTEMS AND METHODS FOR PRODUCTION OF HIGH PRESSURE OXYGEN

(75) Inventor: Alain Briglia, Houston, TX (US)

(73) Assignee: Air Liquide Process and Construction, Inc., Houston, TX (US)

( * ) Notice: Subject to any disclaimer, the term of this patent is extended or adjusted under 35 U.S.C. 154(b) by 0 days.

(21) Appl. No.: 10/321,235

(22) Filed: Dec. 17, 2002

(65) Prior Publication Data

US 2003/0140654 A1 Jul. 31, 2003

Related U.S. Application Data

(60) Provisional application No. 60/343,068, filed on Dec. 20, 2001.

(51) Int. Cl.[7] ..... F25J 3/04
(52) U.S. Cl. ..... 62/654
(58) Field of Search ..... 62/640, 653, 654, 62/903

(56) References Cited

U.S. PATENT DOCUMENTS 2,861,432 A * 11/1958 Haselden et al. ..... 62/29
4,130,160 A 12/1978 Dziedzic et al.
4,345,925 A 8/1982 Cheung
4,715,431 A 12/1987 Schwarz et al.
5,122,174 A 6/1992 Sunder et al.
5,337,571 A 8/1994 Ducrocq et al.
5,592,832 A * 1/1997 Herron et al. ..... 62/646
5,628,207 A 5/1997 Howard et al.
5,655,388 A 8/1997 Bonaquist et al.
5,758,515 A 6/1998 Howard
5,901,579 A 5/1999 Mahoney et al.
5,904,205 A 5/1999 Grenier et al.
6,321,566 B1 * 11/2001 Yamamoto et al. ..... 62/643
6,360,561 B2 3/2002 Allam et al.
6,430,962 B2 8/2002 Miura et al.

* cited by examiner

*Primary Examiner*—Henry Bennett
*Assistant Examiner*—Malik N. Drake
(74) *Attorney, Agent, or Firm*—Linda K. Russell

(57) ABSTRACT

Systems and methods are disclosed for the power efficient production of high-pressure gaseous oxygen product. In a preferred embodiment, a liquid oxygen stream is pumped to a low to medium pressure and warmed within a first heat exchanger such as a brazed aluminum plate fin heat exchanger. The liquid oxygen stream is then pumped to a further pressure and then vaporized in a second heat exchanger to produce a high-pressure gaseous oxygen stream. In an embodiment, a high-pressure air stream may be utilized in the second heat exchanger for vaporizing the oxygen stream and cooling the air stream. The air stream may be utilized as a feed for the cryogenic air unit. A portion of the air stream at a medium pressure may be utilized in the first heat exchanger. A portion of the air stream may also be expanded to recover energy.

38 Claims, 7 Drawing Sheets

SYSTEMS AND METHODS FOR PRODUCTION OF HIGH PRESSURE OXYGEN

RELATED APPLICATION

This application claims benefit of U.S. Provisional Application No. 60/343,068 entitled METHODS AND APPARATUSES FOR PRODUCTION OF HIGH PRESSURE OXYGEN filed on Dec. 20, 2001.

FIELD OF THE INVENTION

Embodiments of the present invention provide a process for production of high-pressure gaseous oxygen and, more specifically, provide a multiple stage process that permits more energy efficient production of high-pressure gaseous oxygen.

BACKGROUND OF THE INVENTION

As used herein, the term "HP" means and refers to high pressure. As used herein, the term "MP" means and refers to medium pressure and is generally used to refer to a pressure that is acceptable for a fin heat exchanger, such as a brazed aluminum plate fin heat exchanger. As used herein, the term "net power" is the power consumed by the process, such as, in an embodiment, the power consumed by the air compressors plus the power consumed by each pump. However, "net power" may be defined otherwise. As used herein, the term "specific power" is the ratio of the net power divided by the gaseous oxygen production flow and will be described in terms of Kw/Nm3, unless otherwise specified. As used herein, units for pressure will be "Bara," unless otherwise specified; units for temperature will be "° C.," unless otherwise specified; units for flow will be "Nm3/h," unless otherwise specified; and, units for power will be "Kw," unless otherwise specified.

It is common to produce high-pressure oxygen gas at the outlet of the cold box by internal compression. Commonly, in air separation units, liquid oxygen is extracted from a distillation column, compressed by a pump and vaporized under pressure to produce high-pressure gaseous oxygen. In order to vaporize the oxygen efficiently, it is necessary in the prior art to condense another stream, which is generally a portion of the incoming air compressed to a pressure sufficient to allow its condensation at a temperature above the vaporizing oxygen. In some cases, the pressure of the oxygen product is such that the corresponding air pressure exceeds the limits of what can be reasonably achieved with the present available technology of efficient heat exchanger technology, such as brazed aluminum plate fin exchanger.

One prior art solution has been to use a spiral wound tubular exchanger, which is able to withstand much higher pressures. However, these exchangers, contrary to plate fin exchangers, cannot accommodate multi-stream exchange in countercurrent directions, i.e. two directions. These exchangers are limited to a few streams in one direction and one stream in the other direction. In this arrangement, such as mentioned in examples found in U.S. Pat. Nos. 5,337,571; 4,345,925, processes must be adapted so that the heat exchange on the oxygen stream takes place in the exchanger in countercurrent passage with a single stream under higher pressure. The stream is typically either air or nitrogen, however, other gases are used. The resulting exchange induces a significant inefficiency, as the temperature difference between the two streams along the exchanger cannot be kept at low values.

More specifically, U.S. Pat. No. 5,337,571, discloses a nitrogen-cycle installation wherein the cycle compressor provides a supply of high-pressure nitrogen which serves to heat oxygen supplied in liquid form from the reservoir of a low-pressure column and raised in pressure by a pump to the desired high production pressure. Oxygen gas may be produced at a pressure exceeding about 50 bars.

U.S. Pat. No. 4,345,925 discloses producing oxygen gas at greater than atmospheric pressure by separating air into oxygen-rich and nitrogen-rich fractions in a distillation column, removing the oxygen as liquid and pumping it to the desired pressure and subsequently vaporizing the pumped liquid oxygen by means of energy absorbed from a recirculation argon containing fluid.

Another prior art example is found in U.S. Pat. No. 5,758,515. This patent discloses a cryogenic air separation system wherein feed air is compressed in a multistage primary air compressor, a first part is turboexpanded and fed into a cryogenic air separation plant, and a second part is turboexpanded and at least a portion of the turboexpanded second part is recycled to the primary air compressor at an interstage position.

Another prior art example is found in U.S. Pat. No. 5,655,388. This patent discloses a cryogenic rectification system wherein liquid oxygen from a cryogenic air separation plant is pressurized and then vaporized in a high pressure liquefier producing product high pressure oxygen gas and generating liquid nitrogen for enhanced liquid product production.

Another prior art example is found in U.S. Pat. No. 5,628,207. This patent discloses a cryogenic rectification system for producing lower purity gaseous oxygen and high purity oxygen employing a double column and an auxiliary column which upgrades lower pressure column bottom liquid or processes higher pressure column kettle liquid.

U.S. Pat. No. 5,901,579, the disclosure of which is incorporated herein by reference speaks to the inefficiencies of the present processes when it states "For an internal compression cycle, efficient, cost effective turndown of the liquid production from the design point cannot be achieved with conventional cycles and/or turbomachinery," in its background section The prior art solution provided by the '579 patent was to construct a cryogenic air separation system wherein base load pressure energy is supplied to the feed air by a base load compressor and custom load pressure energy is supplied to the feed air by a bridge machine having one or more turbine booster compressors and one or more product boiler booster compressors, all of the compressors of the bridge machine driven by power supplied through a single gear case.

BRIEF DESCRIPTION OF THE FIGURES

For a further understanding of the nature and objects of the present invention, reference should be made to the following detailed description, taken in conjunction with the accompanying drawings, in which like elements are given the same or analogous reference numbers and wherein.

DETAILED DESCRIPTION

For purposes of the description of this invention, the terms "upper", "lower", "right", "left", "vertical", "horizontal", "top", "bottom", and other related terms shall be defined as to relation of embodiments of the present invention as it is shown and illustrated in the accompanying Figures. Further, for purposes of the description of this invention, the terms "upper portion," "lower portion," "top," "bottom," and the like shall be defined to mean an upper portion and a lower portion and not specific sections. However, it is to be understood that the invention may assume various alternative structures and processes and still be within the scope and meaning of this disclosure. Further, it is to be understood that any specific dimensions and/or physical characteristics related to the embodiments disclosed herein are capable of modification and alteration while still remaining within the scope of the present invention and are, therefore, not intended to be limiting.

Figure 1:
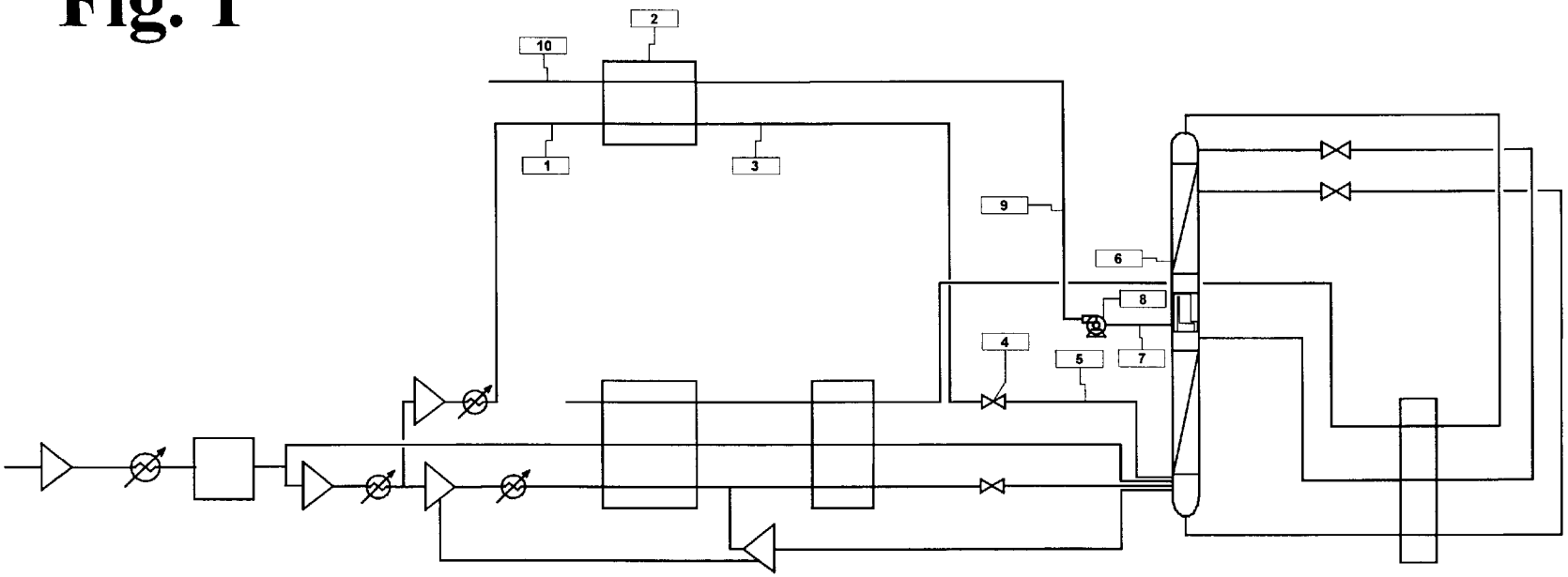
FIG. 1 is an illustration of a prior art unit for the production of a gaseous oxygen product.
Figure 7:
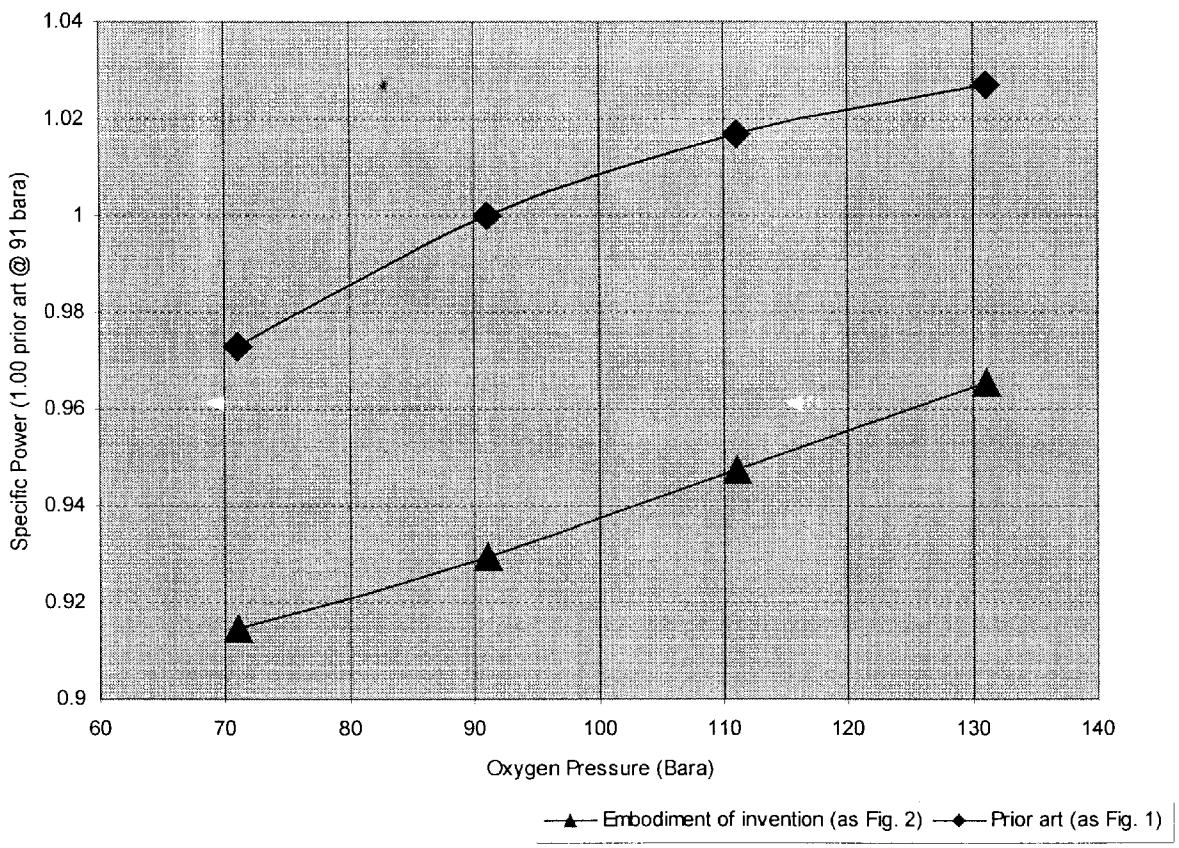
FIG. 7 is graph comparing the specific power required in a prior art system for production of oxygen product versus the specific power required for production of oxygen product according to an embodiment of the present invention.

Generally, the present invention discloses an apparatus and process for the vaporization of a liquid oxygen stream, the process making more efficient use of the heat exchange process, thereby consuming less energy. A prior art liquid oxygen vaporization apparatus and process is illustrated in FIG. 1. The energy efficiency for the system of FIG. 1 is shown in FIG. 7 as compared to the energy efficiency of an embodiment of the present invention as illustrated in FIG. 2.

Referring to FIG. 1, an illustration of a prior art process and apparatus for the vaporization of a liquid oxygen stream, a liquid oxygen stream 7 extracted from column 6 is pumped to pressure in pump 8 and heat exchanged in exchanger 2 for vaporization. Stream 9 is typically vaporized in exchanger 2 against a high-pressure gas, such as high-pressure air 1, to produce a high-pressure gaseous oxygen product stream 10. Stream 3, which may be at least partially liquefied is then expanded through valve 4 to produce stream 5 that is used further down in the process.

Figure 2:
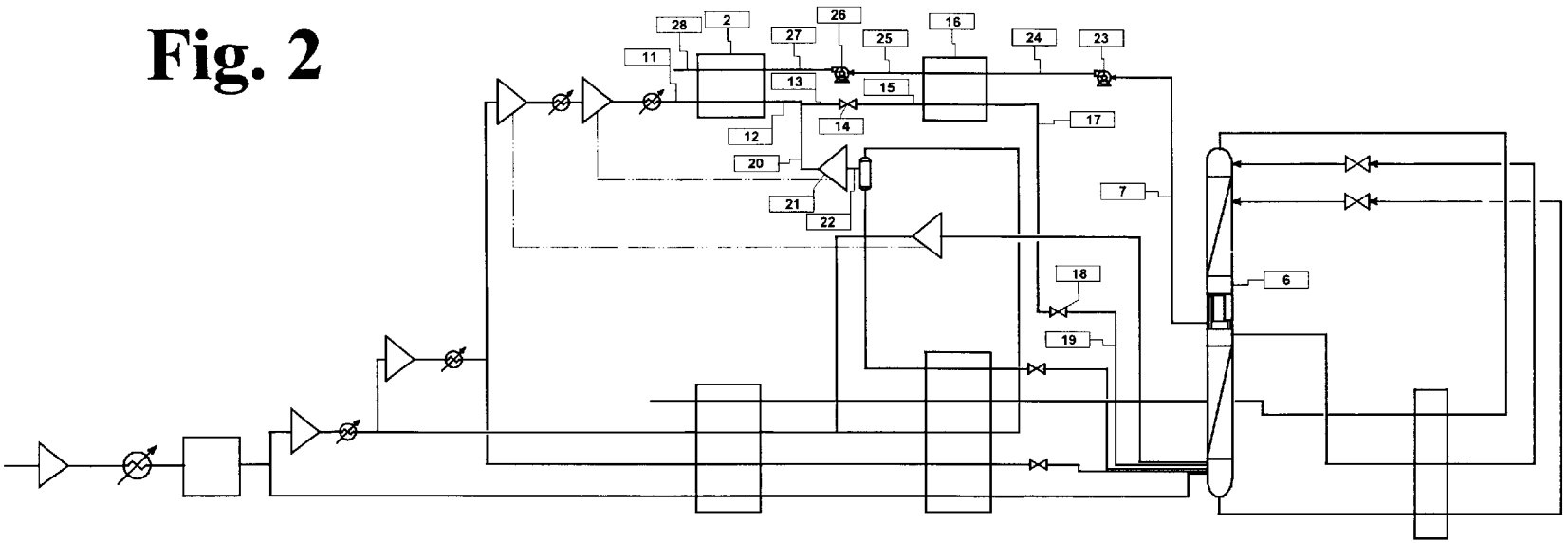
FIG. 2 is an illustration of an embodiment of a unit of the present invention for the production of a gaseous oxygen product.

Now referring to FIG. 2, an illustration of an embodiment of the present invention, a cascade pump cycle is shown. Liquid oxygen stream 7 is pumped in two stages, at two different pressures, to a final pressure. In an embodiment, the final pressure is about 70 Bara and above. However, final pressures of the present invention may vary.

Liquid oxygen stream 7 is pumped in pump 23 to an intermediate pressure at 24, which may preferably be a medium pressure (MP), such as preferably about 30 Bara to about 48 Bara. In various embodiments of the present invention, an intermediate pressure is any pressure equal to or lower than the final pressure. In other embodiments, the intermediate pressure may be limited by process parameters, such as an intermediate MP pressure that is below pressure limitations of equipment, such as a brazed aluminum plate fin heat exchanger. Thus, in one presently preferred embodiment, heat exchanger 16 may comprise an efficient brazed aluminum plate fin heat exchanger. Also in the embodiment(s) using a plate fin heat exchanger, the minimum approach temperature is about 2° C., which is also efficient.

Liquid oxygen stream 24 is then warmed to a temperature that is lower than the boiling temperature of the oxygen at this pressure in exchanger 16 against at least a portion of stream 15. Pump 26 further pumps stream 25 to a higher or high pressure (HP) that is preferably about 50 Bara to about 130 Bara or above, but is more preferably about 70 to about 92 Bara. Stream 27 is then vaporized in heat exchanger 2 to produce gaseous oxygen product stream 28 at the desired pressure. In an embodiment, stream 27 is vaporized in exchanger 2 against high-pressure gas, such as air or nitrogen stream 11.

Stream 11 is cooled in heat exchanger 2 to produce stream 12. Stream 12 may be separated into two streams, stream 13 and stream 20, for example. In one embodiment of the invention, stream 12 is divided into two streams at the outlet of heat exchanger 2. If desired, stream 13 may then be expanded through a valve 14 into stream 15 to reduce the pressure of stream 13. Stream 15 is then passed in heat exchanger 16 with stream 24, thereby cooling stream 15 and warming stream 24. In various embodiments, stream 13 may be reduced in pressure to a pressure that is below acceptable limits for process equipment, such as a brazed aluminum plate fin heat exchanger, which may be utilized as heat exchanger 16. Cooled stream 17 is then expanded across a valve 18 to produce stream 19, which is used further down in the process. Stream 20 is expanded through an expander 21 to produce stream 22 which is used further down in the process.

In various embodiments, including but not limited to the embodiments set forth in the figures, heat exchanger 2 may a spiral wound exchanger, a type of plate fin exchanger which can be used at medium to high pressures, a tubular heat exchanger, a printed circuit type heat exchanger (PCHE), and/or other types of heat exchangers known to one skilled in the art which can be used at medium to high pressures. In various embodiments, including but not limited to the embodiments set forth in the figures, exchanger 16 may be a brazed aluminum plate fin exchanger, another type of plate fin exchanger which can be used at low to medium or intermediate pressures, and/or other types of heat exchangers known to one skilled in the art which can be used at medium or intermediate to high pressures. However, heat exchangers 2 and 16 could also be any type of heat exchangers common in the art. Thus, the present invention also allows for a greater choice of process equipment and flexibility of process parameters.

The present invention discloses a method or process for vaporization of a liquid oxygen stream. Embodiments of the process may comprise the steps of:

- pumping a liquid oxygen stream to an intermediate pressure;
- warming the liquid oxygen stream;
- pumping the warmed liquid oxygen stream to a final pressure; and,
- vaporizing the liquid oxygen stream to produce an oxygen product stream.

Various embodiments of the process of the present invention may further comprise extracting the liquid oxygen stream from a cryogenic air separation unit. Other embodiments vaporize the warmed liquid oxygen stream with a high-pressure gas stream at a temperature greater than the boiling point of oxygen, such as air or nitrogen. Further embodiments of the process warm the liquid oxygen stream with a high-pressure stream, such as nitrogen or air. Other embodiments utilize the feed gas to the cryogenic air separation unit to warm the liquid oxygen stream. The feed gas can be a high-pressure air or nitrogen stream that is expanded across a single or multiple series of valves or a single or multiple expanders after the vaporizing step. The feed gas may be cooled against the liquid oxygen stream, expanded again across a single or a multiple series of valve or a single or multiple expanders and then used in the cryogenic air separation unit. Further embodiments may divide the feed gas into a first divided stream and a second divided stream after the vaporizing step and utilize at least a portion as a feed gas to the cryogenic air separation unit and/or at least a portion to warm the liquid oxygen. Further embodiments may expand the feed gas stream to recover energy, such as to at least partially provide energy for pumping either or both of the liquid oxygen stream or the warmed liquid oxygen stream.

Discussion of various embodiments of the system and processes of the present invention may become apparent to those of skill in the art as various modifications to the systems in accord with the present invention are shown in FIG. 2 through FIG. 6 as possible examples thereof, as discussed in more detail hereinafter.

In the following example, heat exchanger 2 is a spiral wound exchanger and heat exchanger 16 is a brazed aluminum plate fin exchanger. In this embodiment of the present invention, pump 23 pumps oxygen stream 7 to a pressure of about 48 Bara. Pump 26 pumps oxygen stream 25 to a pressure of about 92 Bara. In comparison, the prior art system of FIG. 1 utilized pump 8 to pump oxygen stream 7 to a pressure of about 92 Bara. Thus, the oxygen stream of both systems may have the same high output pressure.

EXAMPLE

A study was conducted comparing an embodiment of the present invention illustrated as FIG. 2 to a prior art embodiment illustrated as FIG. 1.

Several parameters were fixed in order to do this study:

Oxygen purity about 99% O2

Oxygen flow 50000 Nm3/h

Oxygen gaseous product pressure 91 Bara at exchanger outlet

Minimum approach on the Spiral wounded exchanger about 3° C.

Delta T at the Spiral wounded exchanger warm end about 5° C.

Minimum Approach on all the aluminum plate fin exchanger about 2° C.

All expander efficiency is set at about 84%

All compressor efficiency is set at about 80%

All pumps efficiency is set at about 60%

No pressure limitation in the Spiral wounded exchanger

Pressure is limited to 64 Bara in the aluminum plate fin exchanger

Parameters that were studied

Net power, and Specific power of the production of gaseous oxygen from liquid oxygen As the result of this study, the net power and the specific power to produce the same amount of gaseous oxygen at the same conditions are presented in the table below.

| | O2 flow | O2 Pressure | Net Power | Specific Power |
|---|---|---|---|---|
| Prior art | 50,000 Nm3/h | 91 bara | 29,400 Kw | 0.588 Kw/Nm3 |
| Embodiment of the invention studied | 50,000 Nm3/h | 91 bara | 27,300 Kw | 0.546 Kw/Nm3 |

Thus, a system constructed according to the present invention produced a significant overall positive result in energy efficiency as compared to the prior art.

As discussed above, system in accord with the present invention may utilize different configurations. To provide examples thereof, several non-limiting embodiments of variations of the present system are shown below.

1. Embodiment of Cascade Pump Cycle With Single Air Pressure

Figure 3:
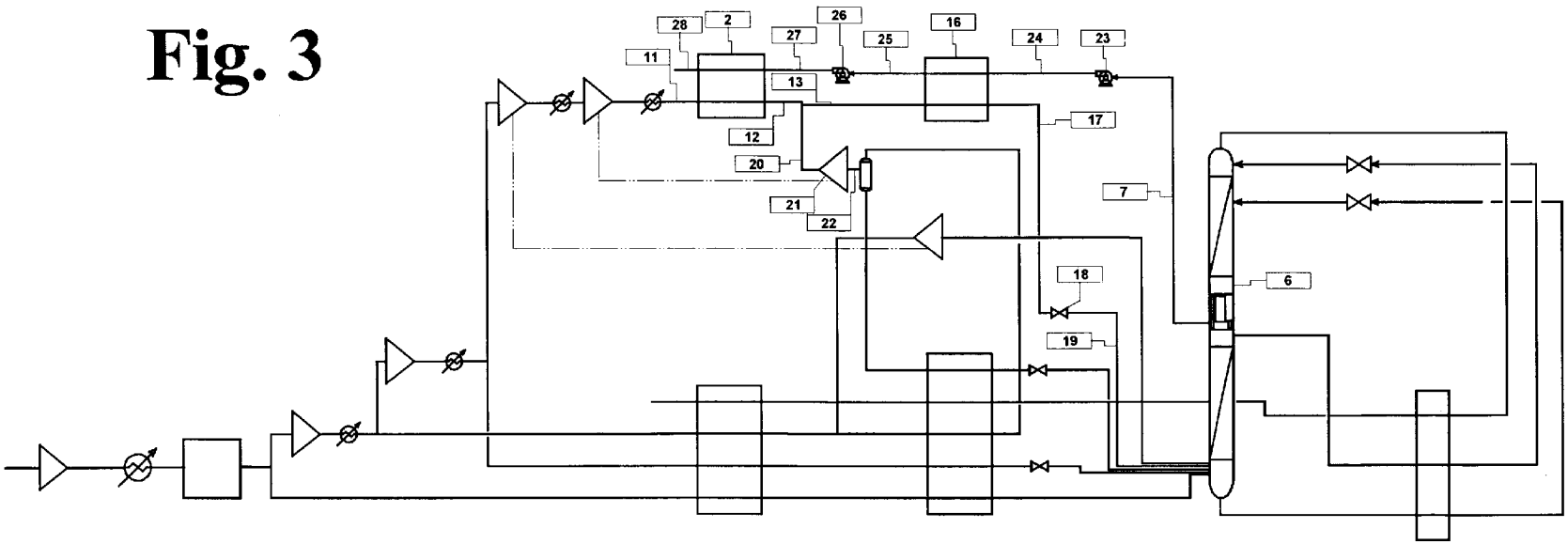
FIG. 3 is an illustration of an alternate embodiment of a unit of the present invention for the production of a gaseous oxygen product.

Now referring to FIG. 3, an illustration of another embodiment of the present invention wherein a cascade pump cycle with single air pressure is shown. Liquid oxygen stream 7 is pumped in 2 stages to a final pressure. First, liquid oxygen stream 7 is pumped in pump 23 to an intermediate pressure. In this particular embodiment, the oxygen stream 7 is pumped to a pressure that is within the acceptable limit for use with fin heat exchangers such as a preferred brazed aluminum plate fin heat exchanger. Thus, heat exchanger 16 may, if desired, be this type of heat exchanger for efficient operation thereof. The MP liquid oxygen stream 24 which enters heat exchanger 16 is warmed to a temperature which is lower than the boiling temperature of the oxygen at this pressure against a portion of stream 12, which could be produced from air, coming out of heat exchanger 2. In this embodiment, heat exchanger 2 may be a spiral wound heat exchanger or other suitable heat exchanger. Pump 26 further pumps oxygen stream 25 to higher pressure. Stream 27 is vaporized in exchanger 2 to produce gaseous oxygen stream 28 at the desired pressure. Stream 27 is vaporized in exchanger 2 against HP gas, such as air stream 11, which is cooled down to produce stream 12.

At the outlet of heat exchanger 2, stream 12 is separated into two streams, stream 20 and stream 13. Stream 13 is used to warm stream 24 in exchanger 16, as discussed above. The cooled down stream 17 is then expanded through expander valve 18 to produce stream 19, which is then used further down in the process. Stream 20 is expanded through an expander 21 to produce stream 22 that is used further down in the process.

2. Embodiment of Cascade Pump Cycle With Dual Air Pressure and Total Expander

Figure 4:
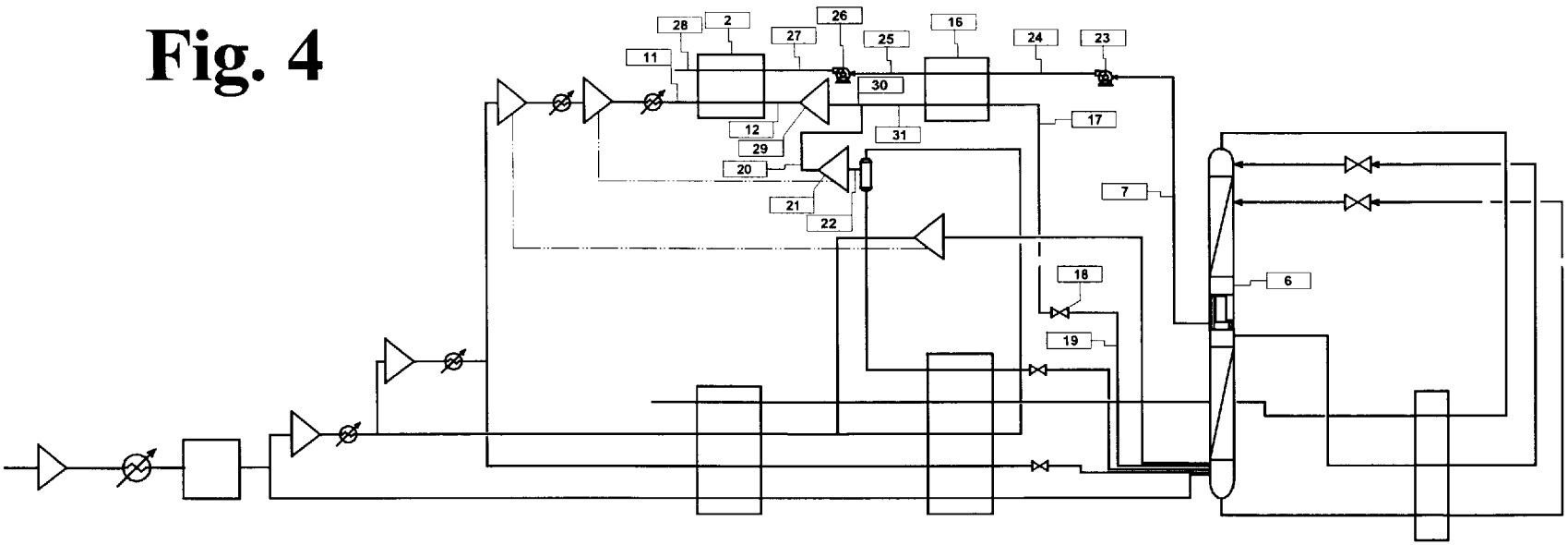
FIG. 4 is an illustration of an alternate embodiment of a unit of the present invention for the production of a gaseous oxygen product.
Figure 5:
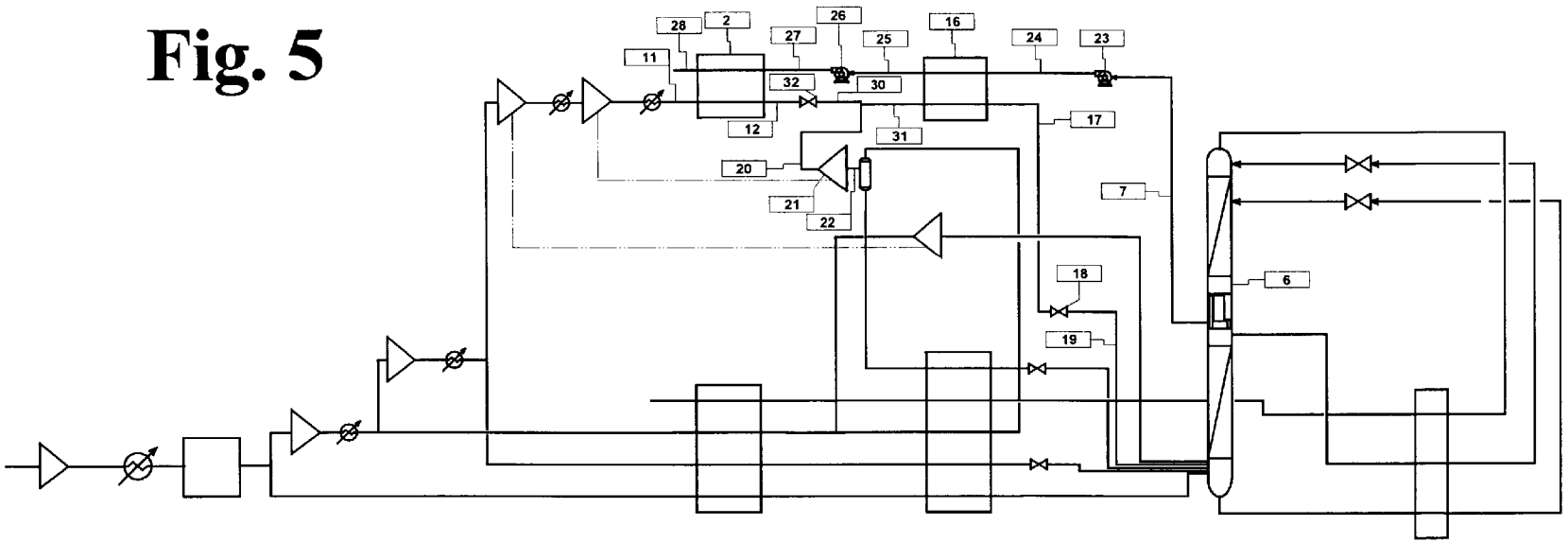
FIG. 5 is an illustration of an alternate embodiment of a unit of the present invention for the production of a gaseous oxygen product.

Now referring to FIG. 4, an illustration of yet another alternate embodiment of the present invention is shown that utilizes a cascade pump cycle with dual air pressure and a total expander. This embodiment is similar to the embodiment of FIG. 3. However, HP air stream 11 is at a higher pressure in exchanger 2. The HP air stream 12 is then expanded in expansion turbine 29 to produce stream 30, which splits into two streams, stream 20 and stream 31. In this embodiment, the pressure of stream 31 which goes to heat exchanger 16 is within or below the acceptable limit for aluminum brazed plate fin type heat exchangers. Therefore, heat exchanger 16 may be an aluminum brazed plate fin type of heat of exchanger. In this embodiment, power is also recovered from expander 29 to thereby improve the overall efficiency of the system.

3. Embodiment of Cascade Pump Cycle With Dual Air Pressure and Total Expansion Valve Now referring to FIG. 5, an illustration is provided of another alternate embodiment of the present invention—a cascade pump cycle with dual air pressure. This embodiment is similar to the embodiment of FIG. 4. The HP air stream 12 is expanded prior to introduction to exchanger 16 to a pressure suitable for aluminum brazed plate fin heat exchangers. Again, if desired, exchanger 16 may be an efficient aluminum brazed plate fin heat exchanger. This reduction of pressure is accomplished in expansion valve 32, instead of an expansion turbine 29 as shown in FIG. 4, before passage of stream 31 into heat exchanger 16.

4. Embodiment of Cascade Pump Cycle With Dual Air Pressure and Partial Expander

Figure 6:
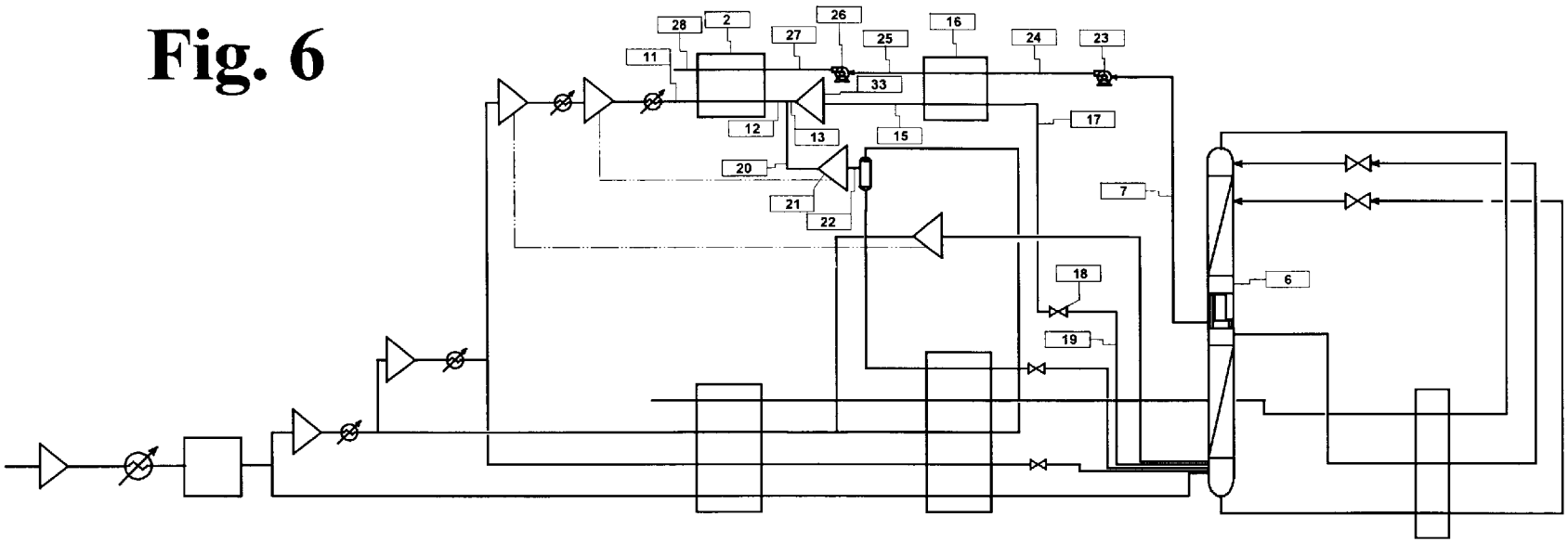
FIG. 6 is an illustration of an alternate embodiment of a unit of the present invention for the production of a gaseous oxygen product.

Now referring to FIG. 6, an illustration of yet another alternate embodiment of the present invention wherein a cascade pump cycle with dual air pressure and partial expander is shown. This embodiment is similar to the embodiment of FIG. 2. However, only a portion of HP air stream 12 is expanded in expander 33, thus allowing higher-pressure air in heat exchanger 2 while reducing the pressure of stream 15 before passage into heat exchanger 16. In this embodiment, the pressure of stream 15 is reduced to a pressure that is suitable for aluminum brazed plate fin heat exchangers so that exchanger 16 may be an aluminum brazed plate fin heat exchanger. In this embodiment, power can be recovered from expander 33.

FIG. 7 illustrates the power efficiency advantages of the present invention as compared to the prior art. More specifically, the chart shows normalized specific power required to produce HP oxygen for different systems. The upper curve represents the efficiency of the prior art system as shown in FIG. 1. The lower curve represents a system in accord with the present invention as shown in FIG. 2 (Specific power 1.00 is chosen for prior art base case at an oxygen pressure of 91 Bara). The results clearly show that the present invention is more efficient based on specific power measurements as compared to the prior art. Thus, the present invention provides embodiments wherein a liquid oxygen stream is pumped and heated in two stages to produce a HP gaseous oxygen product. In the embodiments discussed above, liquid oxygen stream 7 is pumped to produce liquid oxygen stream 24 at a first pressure, preferably a medium pressure. Heat is exchanged within heat exchanger 16 with a first other stream. Heat exchanger 16 is preferably a brazed aluminum plate fin heat exchanger. The liquid oxygen is warmed-up to a temperature, which is preferably lower than the boiling temperature of the oxygen at this pressure to form stream 28. The liquid oxygen stream is then pumped to a second pressure and vaporized against another stream to produce a gaseous oxygen product. In various embodiments, the first pressure is an intermediate or middle pressure that is within the acceptable mechanical limits of fin exchangers, thereby allowing the use of a brazed aluminum plate fin exchanger. A better adaptation of the flows on the rest of the exchange give an overall very positive result in energy efficiency, i.e., a more energy efficient process compared to the prior art.

Again, a variety of types of heat exchangers may be used in this invention and the foregoing specific examples are not meant to be limiting. The types of heat exchangers may include but are not limited to brazed aluminum or stainless steel plate fin exchangers, other types of plate fin exchangers which can be used at low, low to medium, or intermediate pressures, as well as other types of exchangers known to one skilled in the art. At medium or intermediate to high pressures, the types of heat exchangers may include but are not limited, a spiral wound heat exchanger, a tubular heat exchanger, and printed circuit type heat exchangers (PCHE), as well as other types of exchangers known to one skilled in the art.

It will be understood that many additional changes in the details, materials, steps and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

I claim:

1. A process for the production of a high pressure product oxygen stream comprising the steps of:

pumping a liquid oxygen stream to an intermediate pressure;

warming the liquid oxygen stream;

pumping the warmed liquid oxygen stream to a final pressure; and, vaporizing the liquid oxygen stream to produce the high-pressure oxygen product stream.

2. The process of claim 1 further comprising extracting the liquid oxygen stream from a cryogenic air separation unit.

3. The process of claim 2 further comprising the step of vaporizing the warmed liquid oxygen stream with at least a portion of a high pressure feed gas stream for the cryogenic air separation unit that is at a temperature greater than the boiling point of oxygen.

4. The process of claim 3 further comprising dividing the high pressure feed gas stream into a first divided stream and a second divided stream.

5. The process of claim 4 further comprising expanding at least one of the first divided feed stream or the second divided stream.

6. The process of claim 4 wherein the first divided stream is expanded and fed to a cryogenic air separation unit.

7. The process of claim 4 wherein at least one of the first divided stream or the second divided stream is expanded and cooled against the liquid oxygen stream.

8. The process of claim 4 wherein at least one of the first divided stream or the second divided stream is expanded to recover energy.

9. The process of claim 1 further comprising the step of warming the liquid oxygen stream with at least a portion of a high pressure feed gas stream.

10. The process of claim 1 wherein a brazed aluminum plate fin heat exchanger is utilized to perform the step of warming the liquid oxygen stream, and wherein said stream is warmed to less than the critical temperature in said heat exchanger and wherein said stream is pumped to a pressure less than the critical pressure before entering said heat exchanger.

11. The process of claim 10 wherein the warmed liquid oxygen stream is vaporized in a spiral wound heat exchanger, or tubular heat exchanger.

12. The process of claim 10 wherein the warmed liquid oxygen stream is vaporized in a printed circuit heat exchanger.

13. The process of claim 1 wherein the warmed liquid oxygen stream is vaporized in a spiral wound heat exchanger, or tubular heat exchanger.

14. The process of claim 1 wherein the warmed liquid oxygen stream is vaporized in a printed circuit heat exchanger.

15. The process of claim 1 wherein the first heat exchanger utilized to warm the liquid oxygen stream is a plate fin heat exchanger, and wherein said oxygen stream is warmed to less than the critical temperature in said heat exchanger and wherein said oxygen stream is pumped to a pressure less than the critical pressure before entering said heat exchanger.

16. The process of claim 1 wherein the first heat exchanger utilized to warm the liquid oxygen stream is a plate fin heat exchanger, and wherein said liquid oxygen stream is compressed to a final pressure lower than about 80 Bara after leaving said heat exchanger.

17. The process of claim 1, wherein a brazed aluminum plate fin heat exchanger is utilized to perform the step of warming the liquid oxygen stream, and wherein said stream is warmed to less than the critical temperature in said heat exchanger or optionally wherein said stream is pumped to a pressure less than the critical pressure before entering said heat exchanger.

18. The process of claim 1 wherein the first heat exchanger utilized to warm the liquid oxygen stream is a plate fin heat exchanger, and wherein said oxygen stream is warmed to less than the critical temperature in said heat exchanger, or optionally wherein said oxygen stream is pumped to a pressure less than the critical pressure before entering said heat exchanger.

19. A system for producing a high pressure oxygen stream comprising:

a liquid oxygen stream;

a pump for pumping the liquid oxygen stream to an intermediate pressure;

a first heat exchanger for warming the liquid oxygen stream;

a second pump for pumping the warmed liquid oxygen stream to a final pressure; and, a second heat exchanger for vaporizing the warmed liquid oxygen stream.

20. The system of claim 19 further comprising a cryogenic air separation unit for producing the liquid oxygen stream.

21. The system of claim 19 further comprising a feed gas to the cryogenic air separation unit that is at least partially utilized in at least one of the first heat exchanger or the second heat exchanger.

22. The system of claim 21 wherein at least a portion of the feed gas is used in the first heat exchanger and the second heat exchanger.

23. The system of claim 22 further comprising an expander for the feed gas on a feed gas outlet of the second heat exchanger used to vaporize the warmed liquid oxygen stream.

24. The system of claim 21 wherein the second heat exchanger utilized to vaporize the warmed liquid oxygen stream is a spiral wound heat exchanger.

25. The system of claim 21 wherein the first heat exchanger utilized to warm the liquid oxygen stream is an aluminum plate fin heat exchanger, and wherein the critical pressure of said oxygen stream is pumped to a pressure less than the critical pressure before entering first said heat exchanger and wherein said oxygen stream is warmed to less than the critical temperature in said heat exchanger.

26. The system of claim 21 wherein the first heat exchanger utilized to warm the liquid oxygen stream is a plate fin heat exchanger, and wherein said oxygen stream is pumped to a pressure less than the critical pressure before entering said heat exchanger.

27. The system of claim 21 wherein the second heat exchanger utilized to warm the liquid oxygen stream is a printed or tubular heat exchanger.

28. The system of claim 21 wherein the first heat exchanger utilized to warm the liquid oxygen stream is an aluminum plate fin heat exchanger, and wherein the critical pressure of said oxygen stream is pumped to a pressure less than the critical pressure before entering first said heat exchanger, or optionally wherein said oxygen stream is warmed to less than the critical temperature in said heat exchanger.

29. A system for producing a high-pressure oxygen stream comprising:

a cryogenic air separation unit for producing a liquid oxygen stream;

a fin heat exchanger for warming said liquid oxygen stream; and a spiral wound or printed circuit heat exchanger for vaporizing the liquid oxygen stream to produce the high-pressure gaseous oxygen stream.

30. The system of claim 29 wherein the high-pressure gaseous oxygen stream has a pressure greater than or equal to about 70 Bara.

31. The system of claim 29 wherein the oxygen stream entering the fin heat exchanger has an intermediate-pressure from about 40 to about 70 Bara.

32. The system of claim 29 wherein the oxygen stream entering the fin heat exchanger has a intermediate-pressure gaseous oxygen stream from about 40 to about 50.42 Bara.

33. The system of claim 29 wherein the fin heat exchanger is a brazed aluminum fin heat exchanger, and wherein said oxygen stream is warmed to less than the critical temperature in said heat exchanger and wherein the oxygen stream is pumped to a pressure less than the critical pressure before entering said heat exchanger.

34. The system of claim 29 wherein said oxygen stream is warmed to less than the critical temperature in said fin heat exchanger and wherein said oxygen stream is pumped to a pressure less than the critical pressure before entering said fin heat exchanger.

35. The system of claim 29 wherein said warmed liquid oxygen stream is compressed to a final pressure lower than about 80.49 Bara.

36. The system of claim 29 wherein said warmed liquid oxygen stream is compressed to a pressure of about 70 to about 130 Bara.

37. The system of claim 29 wherein the fin heat exchanger is a brazed aluminum fin heat exchanger, and wherein said oxygen stream is warmed to less than the critical temperature in said heat exchanger, or optionally wherein the oxygen stream is pumped to a pressure less than the critical pressure before entering said heat exchanger.

38. The system of claim 29 wherein said oxygen stream is warmed to less than the critical temperature in said fin heat exchanger, or optionally wherein said oxygen stream is pumped to a pressure less than the critical pressure before entering said fin heat exchanger.

* * * * *